US012104603B2

(12) United States Patent
Hsieh et al.

(10) Patent No.: US 12,104,603 B2
(45) Date of Patent: Oct. 1, 2024

(54) CENTRIFUGAL HEAT DISSIPATION FAN

(71) Applicant: Acer Incorporated, New Taipei (TW)

(72) Inventors: Cheng-Wen Hsieh, New Taipei (TW); Wen-Neng Liao, New Taipei (TW); Kuang-Hua Lin, New Taipei (TW); Wei-Chin Chen, New Taipei (TW); Tsung-Ting Chen, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 18/306,252

(22) Filed: Apr. 25, 2023

(65) Prior Publication Data

US 2023/0349386 A1 Nov. 2, 2023

(30) Foreign Application Priority Data

Apr. 29, 2022 (TW) ..... 111116512

(51) Int. Cl.

| | |
|---|---|
| ***F04D 17/10*** | (2006.01) |
| ***F04D 17/16*** | (2006.01) |
| ***F04D 29/28*** | (2006.01) |
| ***F04D 29/30*** | (2006.01) |
| ***F04D 29/66*** | (2006.01) |

(52) U.S. Cl.

CPC ..... *F04D 17/10* (2013.01); *F04D 17/162* (2013.01); *F04D 29/281* (2013.01); *F04D 29/30* (2013.01); *F04D 29/666* (2013.01)

(58) Field of Classification Search

CPC ..... F04D 17/10; F04D 17/162; F04D 29/281; F04D 29/30; F04D 29/666

See application file for complete search history.

(56) References Cited

U.S. PATENT DOCUMENTS

| | | | | |
|---|---|---|---|---|
| 6,653,755 | B2 | 11/2003 | Machiroutu | |
| 2014/0157613 | A1* | 6/2014 | McLain | F04D 29/286 34/139 |
| 2016/0281731 | A1 | 9/2016 | Kim et al. | |
| 2021/0215170 | A1 | 7/2021 | Chen et al. | |

FOREIGN PATENT DOCUMENTS

| | | |
|---|---|---|
| CN | 110296104 | 10/2019 |
| EP | 0964161 | 12/1999 |
| TW | 202126908 | 7/2021 |

* cited by examiner

*Primary Examiner* — Audrey B. Walter
(74) *Attorney, Agent, or Firm* — JCIPRNET

(57) ABSTRACT

A centrifugal heat dissipation fan including a hub, a frame, and double-layer fan blade sets is provided. The double-layer fan blade sets surround the hub and are arranged along a radial direction at an inner layer and an outer layer. A gap is maintained along the radial direction between the fan blade set located at the inner layer and the fan blade set located at the outer layer. The frame is connected to the hub and the fan blade set located at the outer layer.

14 Claims, 7 Drawing Sheets

141
142
140
143

CENTRIFUGAL HEAT DISSIPATION FAN

CROSS-REFERENCE TO RELATED APPLICATION

This application claims the priority benefit of Taiwan application serial no. 111116512, filed on Apr. 29, 2022. The entirety of the above-mentioned patent application is hereby incorporated by reference herein and made a part of this specification.

BACKGROUND OF THE INVENTION

Field of the Invention

The invention relates to a heat dissipation fan, and particularly to a centrifugal heat dissipation fan.

Description of Related Art

As the design trend of portable electronic devices (such as notebook computers or tablet computers) is gradually becoming thinner and lighter, when internal space is extremely limited, the heat dissipation fan mounted therein also needs to be thinned. As a result, when space is limited, the airflow of the heat dissipation fan may not smoothly enter and exit the heat dissipation fan, thereby affecting the heat dissipation efficiency thereof.

Taking centrifugal heat dissipation fans as an example, the existing fan blades are made of metal materials. Compared with fan blades made by injection molding of plastic materials, metal materials may indeed achieve a thinner fan blade structure, so as to obtain more air volume and stronger air pressure.

However, the existing metal fan blades are also faced with the following issues: as the number of fan blades is increased, the combining portions between the fan blades and the hub are also expanded, and therefore the airflow of the centrifugal heat dissipation fan at the suction portion thereof is hindered, which is also counterproductive to the lightening and thinning of the portable electronic device. At the same time, metal fan blades may not be indefinitely thinned and the number of fan blades may not be increased indefinitely, because once the thickness is at a certain degree or less, the metal fan blades are deformed, which is counterproductive to airflow and prone to noise. Similarly, when the number of fan blades exceeds a certain number, difficulties in assembly or production occur.

Therefore, how to change the relevant structure of the existing centrifugal heat dissipation fan to cope with the above issues is actually a topic that those skilled in the art need to consider.

SUMMARY OF THE INVENTION

The invention provides a centrifugal heat dissipation fan provided with double-layer fan blade sets at a surrounding of the hub, so as to achieve the fan blade structure characteristics of both a wave blade and a wheel blade, so as to improve airflow and pressure and reduce noise.

A centrifugal heat dissipation fan of the invention includes a hub, a frame, and double-layer fan blade sets. The double-layer fan blade sets surround the hub and are arranged along a radial direction at an inner layer and an outer layer. A gap is maintained along a radial direction between the fan blade set located at the inner layer and the fan blade set located at the outer layer. The frame is connected to the hub and the fan blade set located at the outer layer.

Based on the above, in the centrifugal heat dissipation fan, double-layer fan blade sets surrounding the hub at an inner layer and an outer layer are disposed in a radial direction in the surrounding of the hub, a gap is maintained between the fan blade set located at the inner layer and the fan blade set located at the outer layer along the radial direction, and the hub and the fan blade set located at the outer layer are connected via the frame. In this way, the double-layer fan blade sets may form an inner layer fan blade set having wave blade characteristics and an outer layer fan blade set having wheel blade characteristics, and with the above configuration, the centrifugal heat dissipation fan may have the advantages of both a wave blade fan blade and a wheel blade fan blade.

In other words, for the double-layer fan blade sets, since the fan blade set located at the inner layer is directly combined with the hub, the design logic of the existing metal fan blades may be maintained, thus maintaining the smoothness of airflow into the centrifugal heat dissipation fan, and achieving the effects of larger amount of airflow and reducing noise. Moreover, for the outer fan blade set, due to the existence of the frame as the combining and support structure, the designer may further reduce the thickness of the fan blades of the outer fan blade set, which is also equivalent to increasing the number of fan blades of the outer fan blade set. At the same time, the number of fan blades of the outer fan blade set may also be adjusted and designed according to the number of fan blades of the inner fan blade set, so as to facilitate noise control.

DESCRIPTION OF THE EMBODIMENTS

Figure 1:
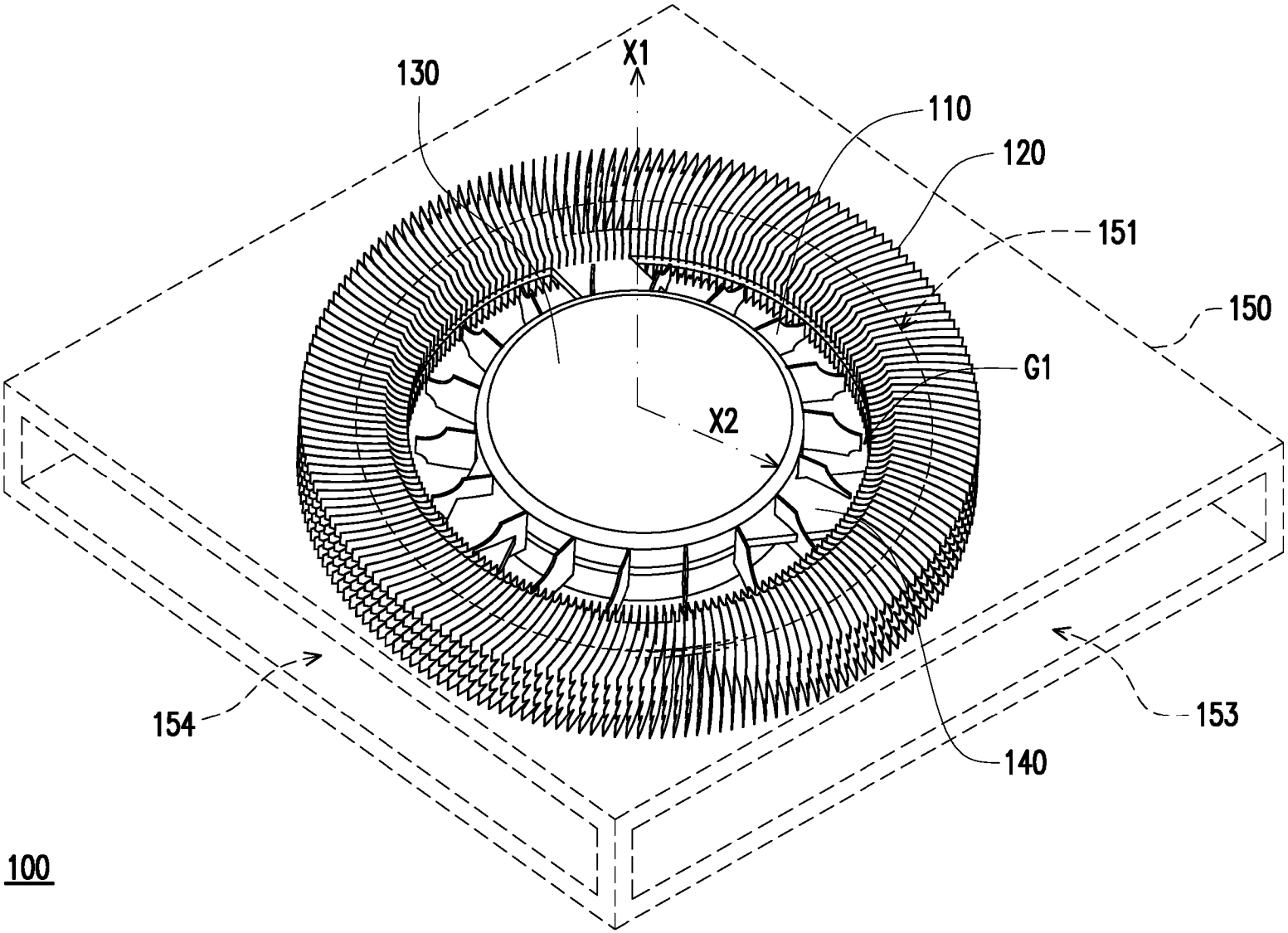
FIG. 1 is a schematic diagram of a centrifugal heat dissipation fan according to an embodiment of the invention.
Figure 2:
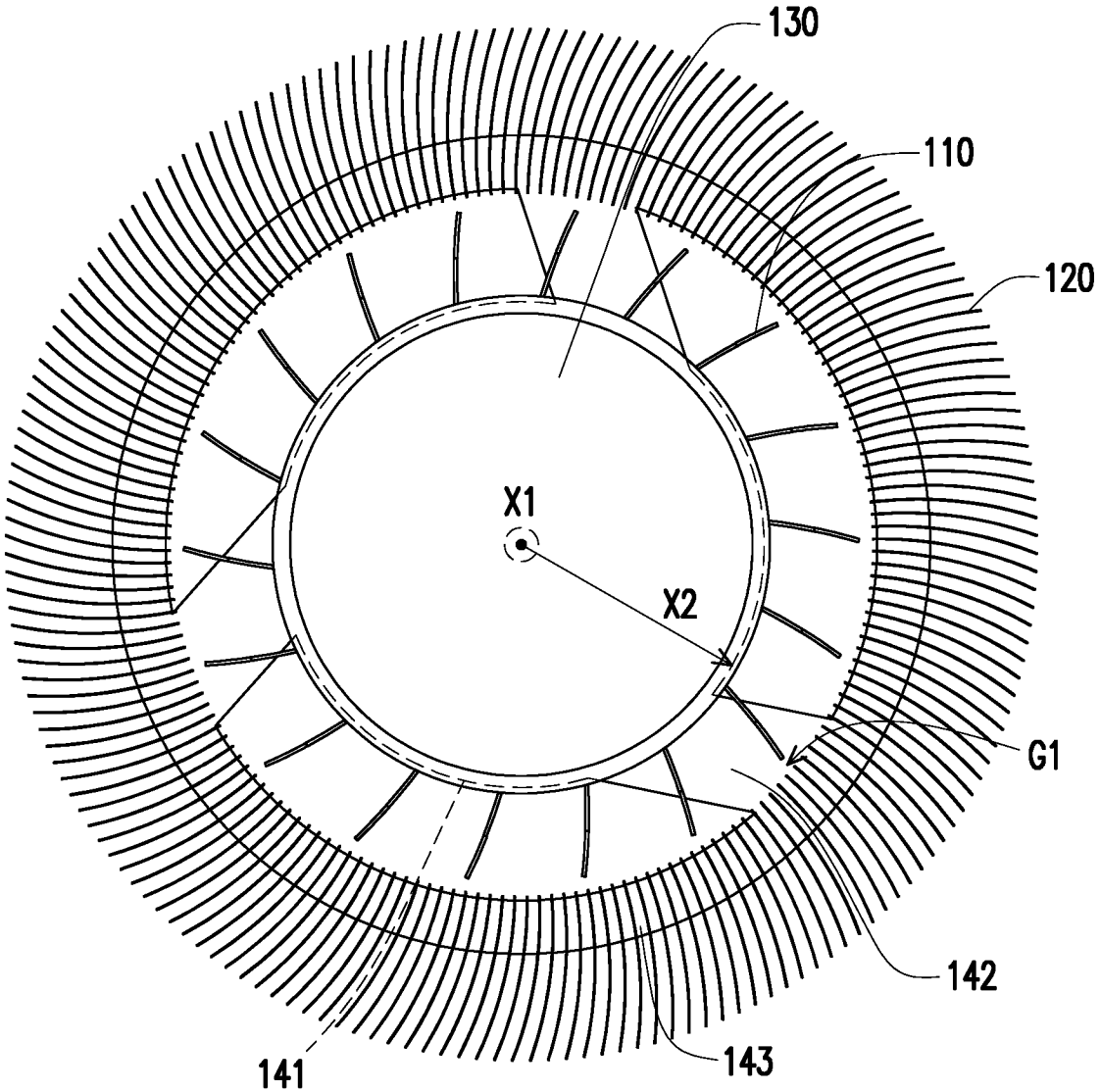
FIG. 2 is a plan view of some members of the centrifugal heat dissipation fan of FIG. 1.
Figure 3:
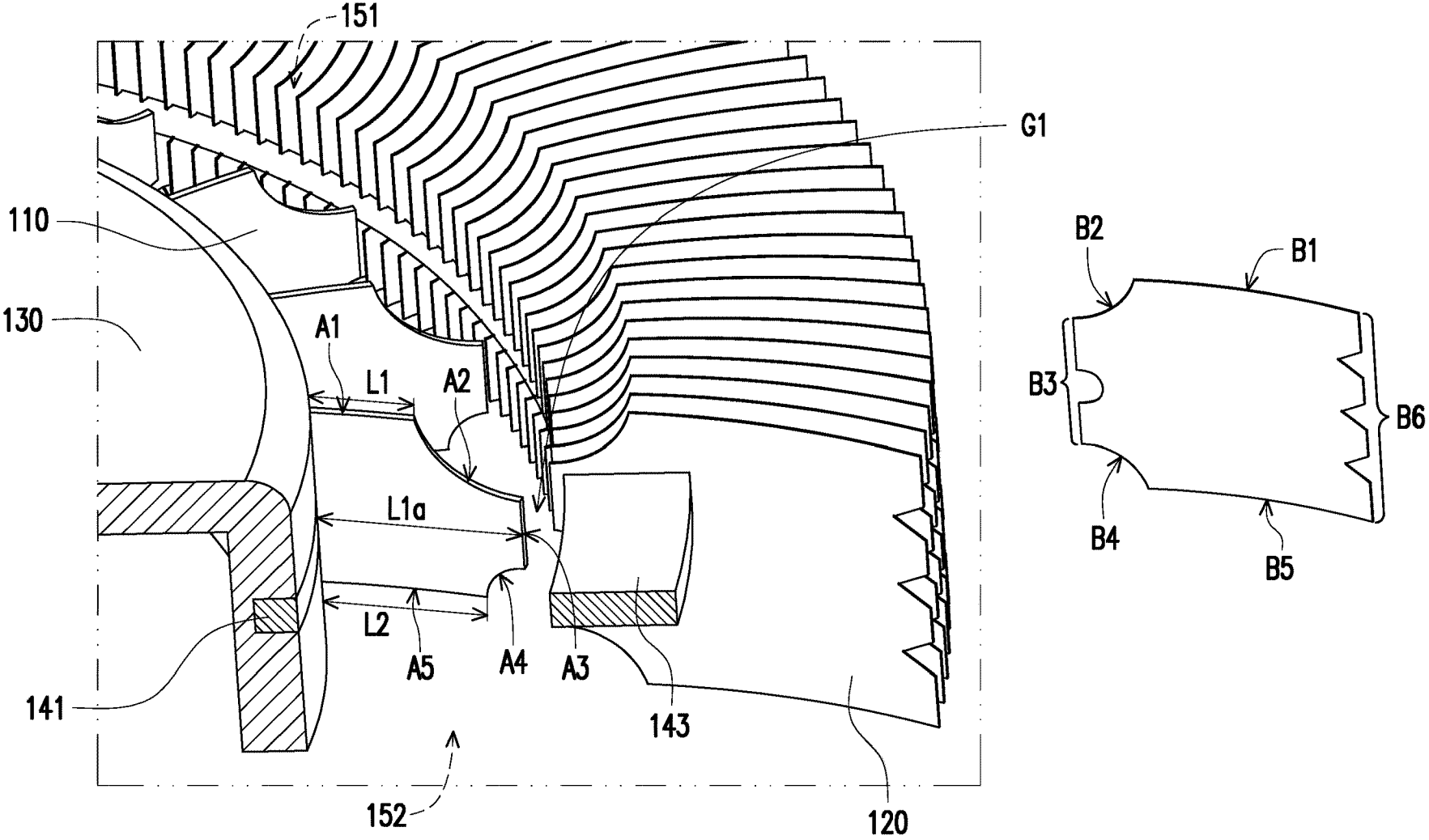
FIG. 3 is a partial cross-sectional view of the centrifugal heat dissipation fan of FIG. 1.

FIG. 1 is a schematic diagram of a centrifugal heat dissipation fan according to an embodiment of the invention. FIG. 2 is a plan view of some members of the centrifugal heat dissipation fan of FIG. 1. FIG. 3 is a partial cross-sectional view of the centrifugal heat dissipation fan of FIG. 1. Please refer to FIG. 1 to FIG. 3 at the same time, in the present embodiment, a centrifugal heat dissipation fan 100 include a hub 130, a fan blade set 110 and a fan blade set 120, a frame 140, and a casing 150, wherein the hub 130, the fan blade set 110, the fan blade set 120, and the frame 140 are disposed in the casing 150 and rotated along an axial direction X1, and at the same time the casing 150 has two air inlets 151 and 152 located on the axial direction X1 and at least one air outlet located on a radial direction X2 (the present embodiment shows two air outlets 153 and 154 as an example). When the centrifugal heat dissipation fan 100 is operating, the airflow is adapted to enter the casing 150 from the air inlets 151 and 152 and flow out of the casing 150 from the air outlets 153 and 154.

More specifically, the double-layer fan blade sets (the fan blade sets 110 and 120) of the present embodiment surround the hub 130 at an inner layer and an outer layer along the radial direction X2, wherein a gap G1 is maintained between the fan blade set 110 located at the inner layer and the fan blade set 120 located at the outer layer along the radial direction X2, and the frame 140 is connected to the hub 130 and the fan blade set 120 located at the outer layer. Moreover, the fan blade set 110 located at the inner layer is directly structurally combined to the hub 130, and the fan blade set 120 located at the outer layer is indirectly combined to the hub 130 via the frame 140. In short, the fan blade set 110 located at the inner layer has wave blade characteristics, and the fan blade set 120 located at the outer layer has wheel blade characteristics, wherein the biggest difference between the two is whether the fan blades are directly connected to the hub 130.

The fan blade set 110 and the hub 130 are combined with a heterogeneous material. For example, metal fan blades are combined with the hub 130 made of a plastic material by means of embedding and injection. Alternately, plastic fan blades may also be integrally formed with the hub 130, or metal fan blades are combined with the hub 130 made of a metal material by casting means. As a result, the fan blade set 110 directly structurally combined with the hub 130 is located on the axial direction X1 corresponding to the air inlets 151 and 152, and is used as the main structure for introducing the air from the external environment into the casing 150 when the centrifugal heat dissipation fan 100 is operating. The use of the wave blade structure thereof may improve the amount of flow and degree of smoothness of the airflow flowing into the casing 150. In another embodiment not shown, the fan blade set and the hub may also be made by means of plastic integral molding, or a hub made of plastic and metal (made by sheet metal or die-casting) fan blades are combined with each other, or a metal (made by die-casting) hub and metal (made by sheet metal) fan blades are combined with each other.

More specifically, as shown in FIG. 3, in the plurality of fan blades of the fan blade set 110 located at the inner layer, each fan blade has arc-shaped side edges A2 and A4, and the notches of the arc-shaped side edges A2 and A4 face the air inlet 151 (the axial direction X1) and the air outlets 153 and 154 (the radial direction X2, shown in FIG. 1), in order to guide the airflow flowing into the centrifugal heat dissipation fan 100 from the air inlets 151 and 152 to the fan blade set 120 located at the outer layer.

As shown in FIG. 3, each fan blade of the fan blade set 110 has a top edge A1 corresponding to the air inlet 151, a bottom edge A5 corresponding to the air inlet 152, and a side edge A3 corresponding to the air outlet 153 or 154 (the radial direction X2), the arc-shaped side edge A2 is adjoined between the top edge A1 and the side edge A3, and the arc-shaped side edge A4 is adjoined between the bottom edge A5 and the side edge A3, wherein the top edge A1 has a radial dimension L1, the bottom edge A5 has a radial dimension L2, and the side edge A3 has a radial dimension L1*a*, the radial dimension L1 is smaller than the radial dimension L1*a*, and the radial dimension L2 is smaller than the radial dimension L1*a*. Therefore, the radial dimension of each fan blade of the fan blade set 110 is increased gradually from the air inlets 151 and 152 (the axial direction X1) to the air outlets 153 and 154 (the radial direction X2), so as to provide the above airflow guiding effect.

Here, from the perspective of each fan blade of the fan blade set 110, under the premise that the rotational speed of the hub 130 is fixed, each fan blade of the fan blade set 110 has a larger tangential velocity at the side edge A3, and the top edge A1 or the bottom edge A5 has a smaller tangential velocity due to the size limitation and the arc-shaped side edges A2 and A4. In this way, the area with fast tangential velocity means that there is a smaller airflow pressure. Therefore, each fan blade of the fan blade set 110 may not only smoothly guide the airflow into the fan blade set 110, but also increase the ability to absorb outside air due to the radially expanding design thereof.

In contrast, in the plurality of fan blades of the fan blade set 120 located at the outer layer, each fan blade has arc-shaped side edges B2 and B4, and the notches of the arc-shaped side edges B2 and B4 face the air inlets 151 and 152 (the axial direction X1) and the hub 130, and the arc side edges A2 and A4 of the fan blade set 110 are opposite to each other, so that the fan blade set 120 located at the outer layer may smoothly receive the airflow guided from the fan blade set 110. Moreover, as shown in FIG. 3, the arc side edges A2, A4, B2, and B4 of the present embodiment have different radians, which also means that the air inlets 151 and 152 of the casing 150 may also be designed with different sizes or shapes.

Please refer further to FIG. 2 and FIG. 3, in the present embodiment, the frame 140 includes a first combining portion 141, a connecting portion 142, and a second combining portion 143, the first combining portion 141 is combining to the hub 130, the second combining portion 143 is combined to the fan blade set 120 located at the outer layer, and the connecting portion 142 is connected between the first combining portion 141 and the second combining portion 143. Here, a portion of the fan blades of the fan blade set 110 located at the inner layer is also combined to the connecting portion 142. Because the fan blade set 120 uses the frame 140 as the combining and support structure between itself and the hub 130, different from the fan blade set 110, the fan blade set 120 apparently has the characteristics of a wheel blade. That is to say, the frame 140 is used as the support base thereof, so for each fan blade of the fan blade set 120, the thickness thereof may be further reduced without worrying about the influence of insufficient structural strength. This is also equivalent to increasing the number of fan blades of the fan blade set 120, and there is no need to worry about the above issue of difficult assembly. For example, the thickness of each fan blade of the fan blade set 120 located at the outer layer may be less than or equal to 0.08 mm, and due to the existence of the second combined portion 143, there is no need to worry about insufficient rigidity of the fan blade.

In short, the fan blade set 120 located at the outer layer may be made of metal material, so that the number of fan blades of the fan blade set 110 located at the inner layer is less than or equal to the number of fan blades of the fan blade set 120 located at the outer layer, and the thickness of the fan blades of the fan blade set 120 located at the outer layer is smaller than the thickness of the fan blades of the fan blade set 110 located at the inner layer. In this way, the light and thin fan blade structure and the increase in the number of fan blades may both effectively improve the amount of airflow and airflow pressure of the fan blade set 120 located at the outer layer. Moreover, the designer may also suitably adjust the noise generated by the centrifugal heat dissipation fan 100 during operation by suitably adjusting the number of fan blades of the inner fan blade set 110 and the number of fan blades of the outer fan blade set 120. In other words, the difference in the number of fan blades of the double-layer fan blade sets 110 and 120 may prevent the centrifugal heat dissipation fan 100 from continuously generating high-frequency or low-frequency noise.

Referring further to FIG. 3, in the present embodiment, each fan blade of the fan blade set 120 further has a top edge B1, a bottom edge B5, an inner edge B3, and an outer edge B6, wherein the inner edge B3 is opposite to the side edge A3 of the fan blades of the fan blade set 110 and a gap G1 is maintained between the two, the top edge B1 corresponds to the air inlet 151, the bottom edge B5 corresponds to the air inlet 152, and the outer edge B6 is used to correspond to the air outlets 153 and 154. Here, each fan blade of the fan blade set 120 also has a plurality of cutout structures located at the outer edge B6 for increasing the airflow and increasing the generation of turbulence during discharge from the air outlets 153 and 154, so as to reduce the noise generated by the air outlets 153 and 154.

Figure 4:
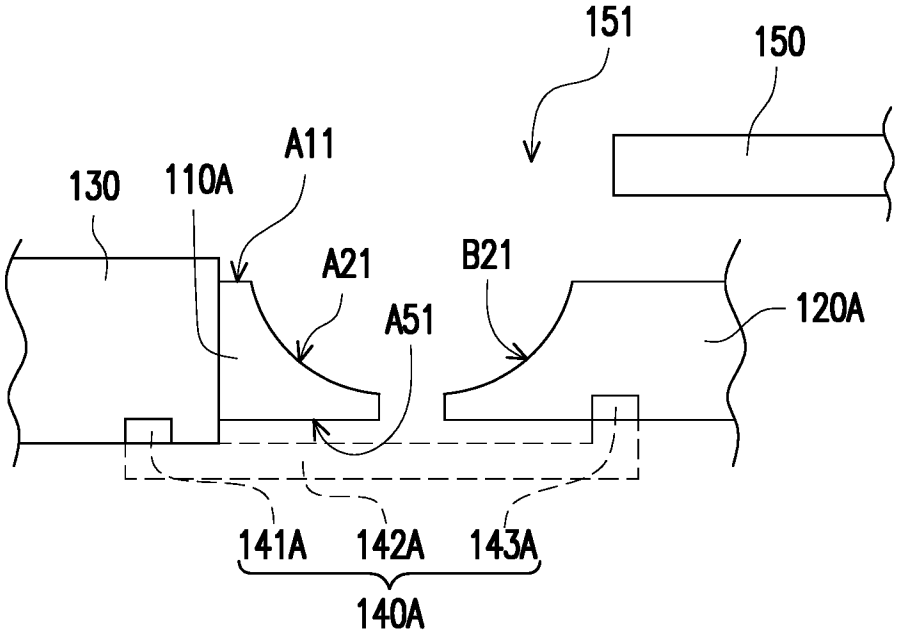
FIG. 4 is a partial schematic diagram of a centrifugal heat dissipation fan according to another embodiment of the invention.

FIG. 4 is a partial schematic diagram of a centrifugal heat dissipation fan of another embodiment of the invention, showing a portion of the centrifugal heat dissipation fan from a side view. Referring to FIG. 4, in the present embodiment, different from the pair of arc-shaped side edges A2 and A4 existing in the above embodiments, each fan blade of the fan blade set 110A of the present embodiment only has an arc-shaped side edge A21 facing the air inlet 151 (the axial direction X1) and the air outlets 154 and 154 (the radial direction X2), and a fan blade set 120A also only has an arc-shaped side edge B21 facing the air inlet 151 (the axial direction X1) and the air outlets 153 and 154 (the radial direction X2). What remains unchanged is that the radial dimension of the fan blade set 110 is still increased gradually from the air inlet 151 (the axial direction X1) to the air outlets 154 and 154 (the radial direction X2), in order to smoothly guide the airflow from the air inlet 151 to the fan blade set 120A. Here, the radial dimension of the blade set 110A at the top edge A11 thereof is smaller than the radial dimension at the bottom edge A51 thereof.

Figure 5:
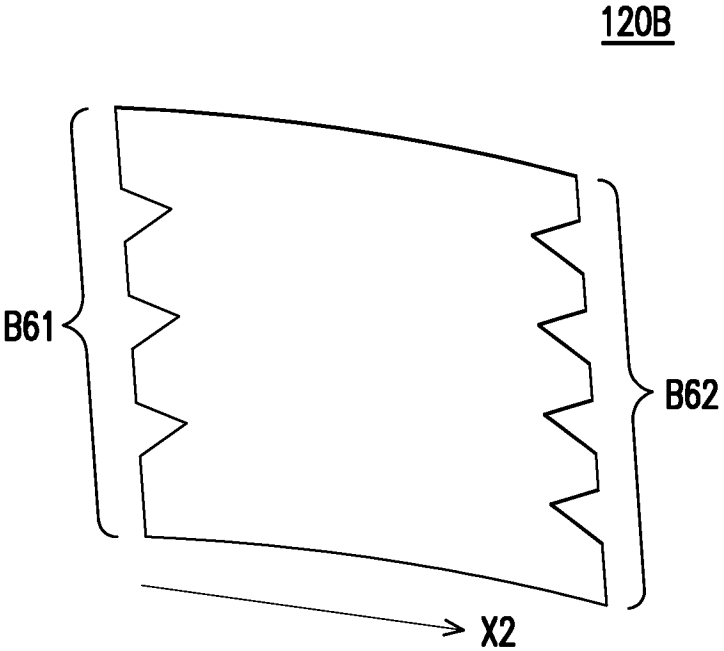
FIG. 5 is a schematic diagram of an outer fan blade according to another embodiment of the invention.

FIG. 5 is a schematic diagram of an outer fan blade according to another embodiment of the invention. Please refer to FIG. 5 and compare with FIG. 3, different from the above embodiments, only the outer edge B6 has a cutout structure, the fan blades of the fan blade set 120B of the present embodiment all have cutout structures at both an inner edge B61 and an outer edge B62 thereof, and in the present embodiment, the number of cutouts at the outer edge B62 is greater than the number of cutouts at the inner edge B61.

Please refer to FIG. 3 again, in the present embodiment, the frame 140 and the fan blade set 120 located at the outer layer are combined using a heterogeneous material. That is, the fan blades of the fan blade set 120 are made of a metal material, and are combined with the frame 140 by means of embedding and injection, wherein a portion of the fan blades of the fan blade set 110 at the inner layer may also be combined to the connecting portion 142 or the first combining portion 141 of the frame 140. Here, the second combining portion 143 is substantially coupled to the center of the fan blades of the fan blade set 120, and particularly corresponds to the notch of the inner edge B3. Next, referring to FIG. 4, a frame 140A of the present embodiment also includes a first combining portion 141A, a second combining portion 143A, and a connecting portion 142A. The difference from the above embodiments is that the frame 140A is located opposite the air inlet 151, so that the first combining portion 141A is combined to the bottom of the hub 130, and the second combining portion 143A is combined to the bottom of the fan blades of the fan blade set 120A, so as to match the contour trend of the arc-shaped side edges A21 and B21.

Figure 6:
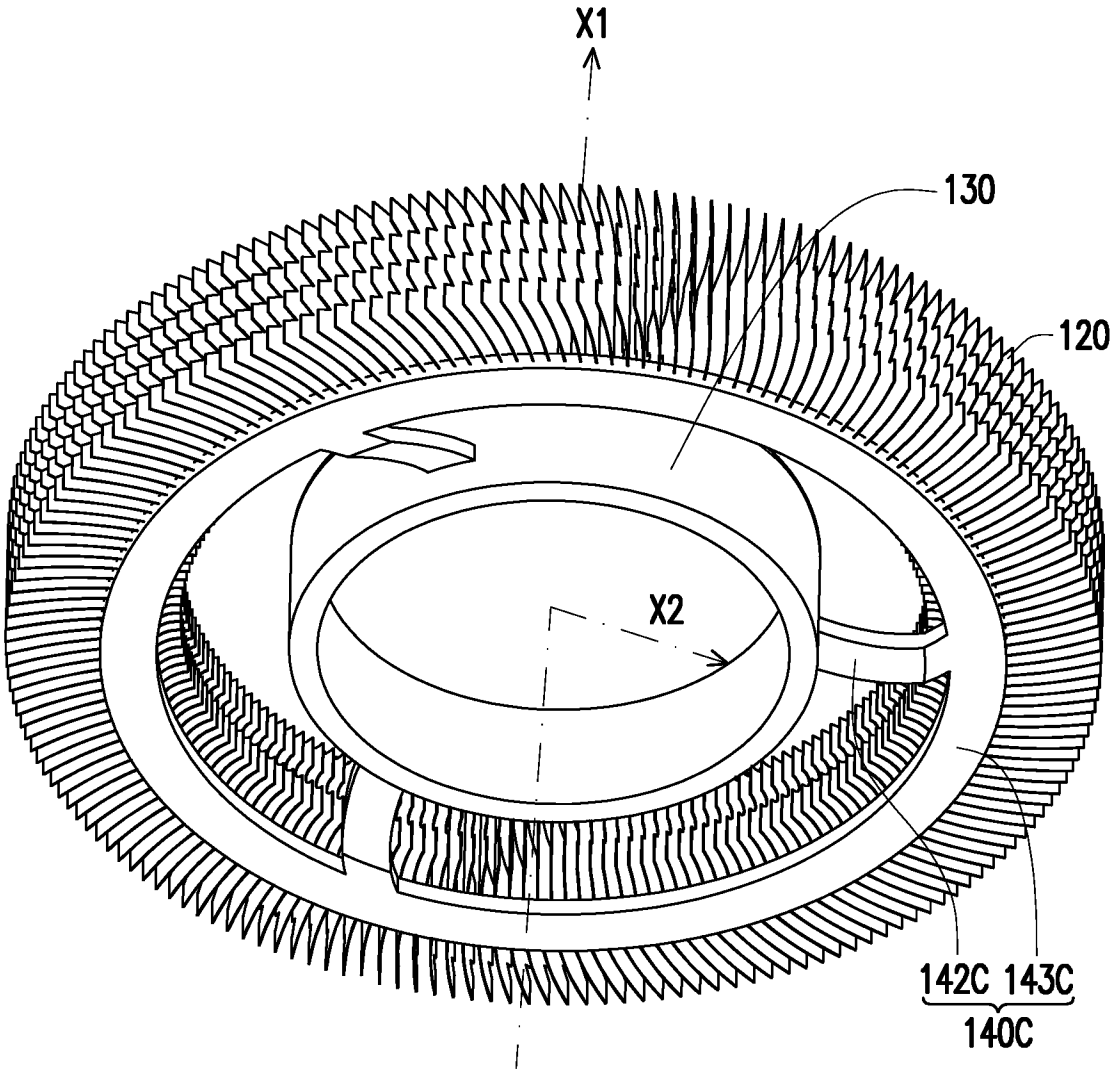
FIG. 6 is a schematic diagram of a centrifugal heat dissipation fan according to another embodiment of the invention.
Figure 7:
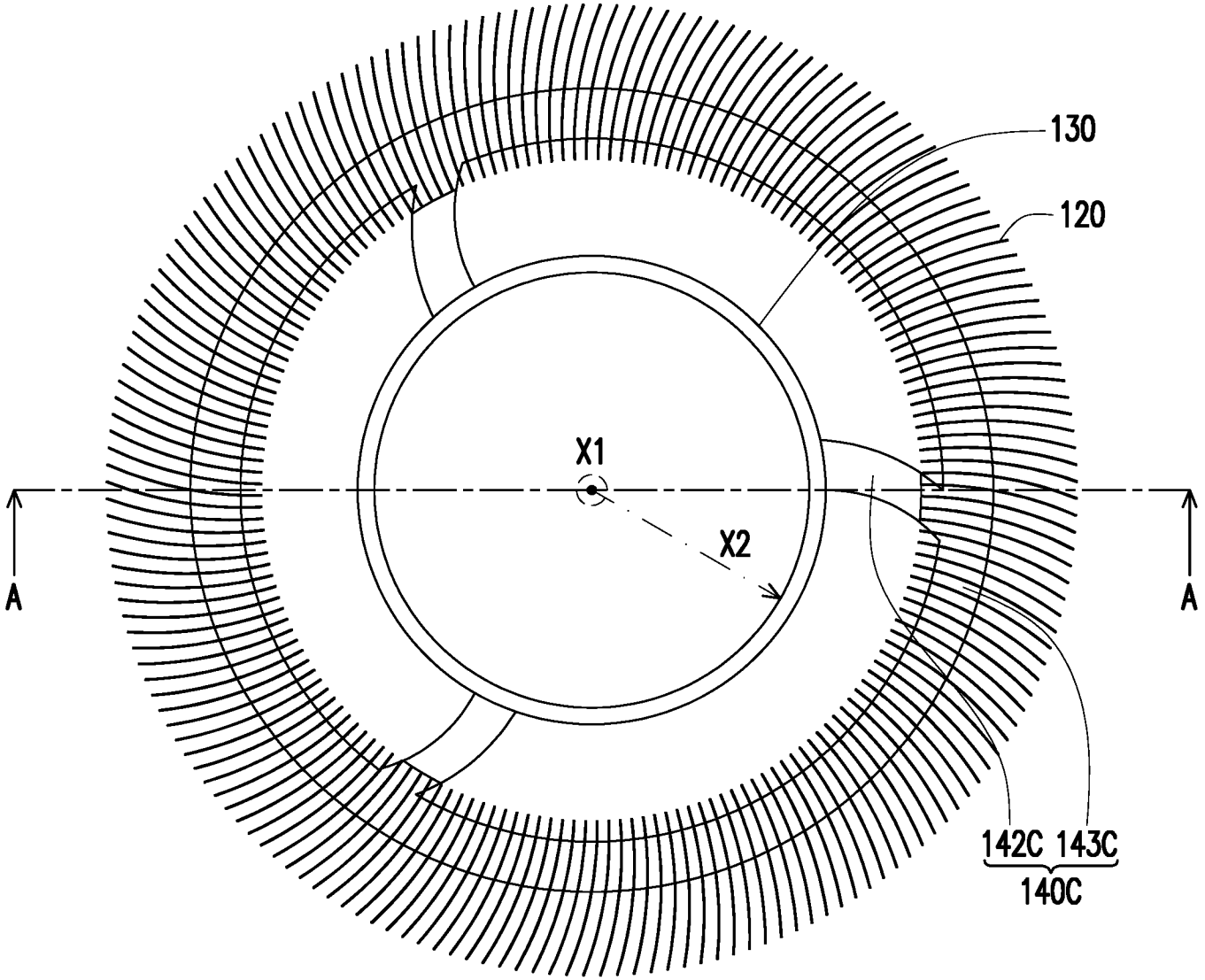
FIG. 7 is a top view of the centrifugal heat dissipation fan of FIG. 6.
Figure 8:
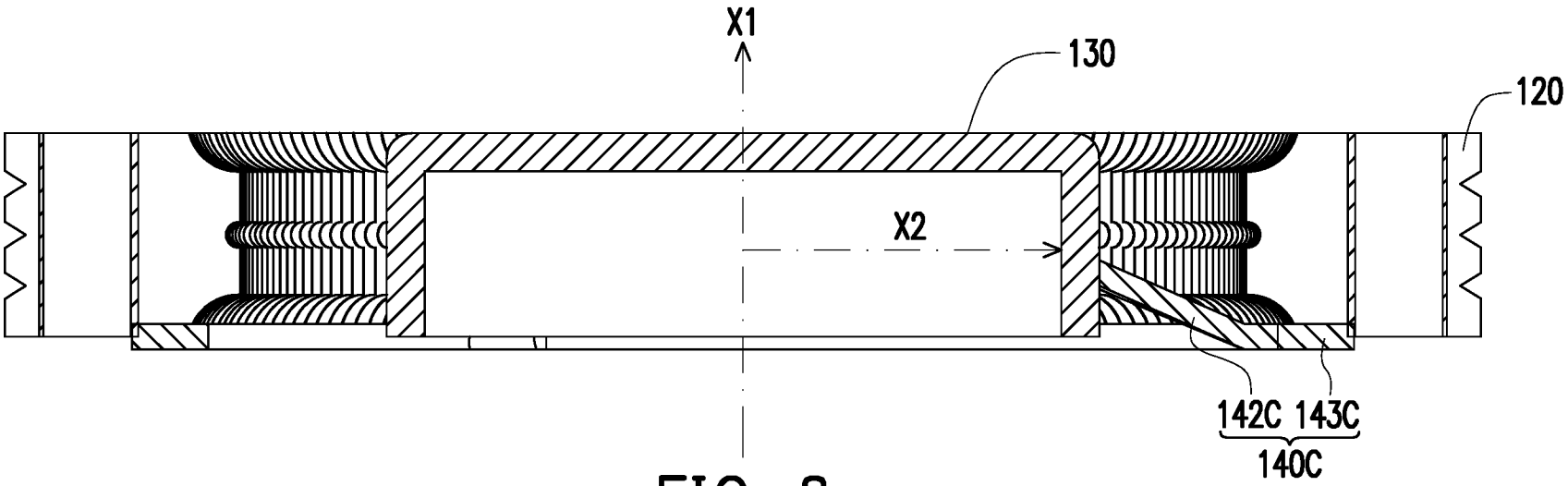
FIG. 8 is a cross-sectional view of the centrifugal heat dissipation fan of FIG. 6.

FIG. 6 is a schematic diagram of a centrifugal heat dissipation fan according to another embodiment of the invention. FIG. 7 is a top view of the centrifugal heat dissipation fan of FIG. 6. FIG. 8 is a cross-sectional view of the centrifugal heat dissipation fan of FIG. 6, which is taken along the section line A-A shown in FIG. 7. Please refer to FIG. 6 to FIG. 8, the fan blade structure of the present embodiment is closer to that shown in FIG. 4. That is, a frame 140C includes a combining portion 142C and a combining portion 143C, and the frame 140C is substantially integrally formed with the hub 130, so that the combining portion 142C is extended from the hub 130 along the radial direction X2 to be connected to the combining portion 143C. The combining portion 143C is, for example, a ring concentric with the hub 130 (the same rotation center, that is, the axial direction X1), and is used for combining each fan blade of the fan blade set 120. More importantly, the fan blade set 120 of the present embodiment is the fan blade set 120 located at the outer layer in the above embodiments, and the combining portion 143C is combined with the bottom of the fan blade set 120, so that each fan blade of the fan blade set 120 may pass through the combining portion 143C as a combining and support structure thereof.

Figure 9:
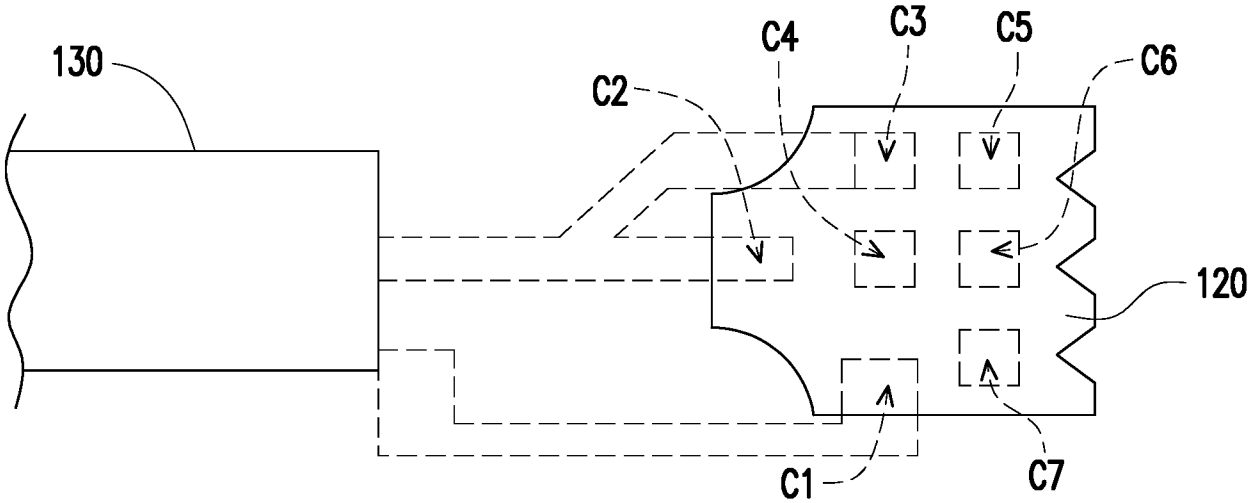
FIG. 9 is a schematic diagram of a combination of relevant members of a centrifugal heat dissipation fan of the invention.

FIG. 9 is a schematic diagram of a combination of relevant members of a centrifugal heat dissipation fan of the invention. Please refer to FIG. 9, which shows possible combining portions C1 to C7 of the frame and the outer fan blade set 120, that is, the frame may be combined with at least one of the combining portions C1 to C7. Here, the area of the frame and the combining portions C1 to C7 of the fan blades is about 10% to 20% of the overall area of the fan blades. In other words, the frame may be combined with the desired position as needed, and may also be combined to the plurality of combining portions C1 to C7 at the same time. Under the premise that the fan blade set 120 may use the frame as the support structure thereof and ensure the structural strength of the fan blades, the designer may determine the positions of the combining portions C1 to C7 according to the conditions of the fan blades (e.g., shape, size, and thickness). FIG. 9 only provides a possible form of connecting the frame to the combining portions C1 to C3, but it is not limited thereto.

Based on the above, in the above embodiments of the invention, in the centrifugal heat dissipation fan, double-layer fan blade sets surrounding the hub at an inner layer and an outer layer are disposed in a radial direction in the surrounding of the hub, a gap is maintained between the fan blade set located at the inner layer and the fan blade set located at the outer layer along the radial direction, and the hub and the fan blade set located at the outer layer are connected via the frame. In this way, the double-layer fan blade sets may form an inner layer fan blade set having wave blade characteristics and an outer layer fan blade set having wheel blade characteristics, and with the above configuration, the centrifugal heat dissipation fan may have the advantages of both a wave blade fan blade and a wheel blade fan blade.

In other words, for the double-layer fan blade sets, since the fan blade set located at the inner layer is directly combined with the hub, the design logic of the existing metal fan blades may be maintained, thus maintaining the smoothness of airflow into the centrifugal heat dissipation fan, and achieving the effects of larger amount of airflow and reducing noise. Moreover, for the outer fan blade set, due to the existence of the frame as the combining and support structure, and especially due to heterogeneous material combining means of metal fan blades with plastic or metal, the structural strength of the fan blade set located at the outer layer may be effectively improved. Therefore, the designer may further reduce the fan blade thickness of the outer fan blade set. This action is also equivalent to increasing the number of fan blades of the outer fan blade set, and also increases the airflow pressure of the centrifugal fan at the exhaust thereof, thereby improving heat dissipation efficiency. At the same time, the number of fan blades of the outer fan blade set may also be adjusted and designed according to the number of fan blades of the inner fan blade set, so as to facilitate noise control.

What is claimed is:

1. A centrifugal heat dissipation fan, comprising:

a hub;

a frame; and double-layer fan blade sets surrounding the hub at an inner layer and an outer layer in a radial direction, wherein a gap is maintained between the fan blade set located at the inner layer and the fan blade set located at the outer layer along the radial direction, and the frame is connected to the hub and the fan blade set located at the outer layer, wherein the centrifugal heat dissipation fan has two air inlets disposed along an axial direction and at least one air outlet disposed along the radial direction, wherein in a plurality of fan blades of the fan blade set located at the inner layer, each of the fan blades has a pair of arc-shaped side edges, and a notch of each of the arc-shaped side edges faces one of the two air inlets and the at least one air outlet.

2. The centrifugal heat dissipation fan of claim 1, wherein a number of fan blades of the fan blade set located at the inner layer is less than or equal to a number of fan blades of the fan blade set located at the outer layer.

3. The centrifugal heat dissipation fan of claim 1, wherein in the plurality of fan blades of the fan blade set located at the inner layer, a radial dimension of each of the plurality of fan blades is increased gradually from one of the two air inlets to the at least one air outlet.

4. The centrifugal heat dissipation fan of claim 1, wherein the hub is combined with the fan blade set located at the inner layer using a heterogeneous material.

5. The centrifugal heat dissipation fan of claim 1, wherein the frame is combined with the fan blade set located at the outer layer using a heterogeneous material.

6. The centrifugal heat dissipation fan of claim 1, wherein a portion of fan blades of the fan blade set located at the inner layer is combined to the frame.

7. The centrifugal heat dissipation fan of claim 1, wherein a material of the fan blade set located at the inner layer is metal or plastic.

8. The centrifugal heat dissipation fan of claim 1, wherein a material of the fan blade set located at the outer layer is metal.

9. The centrifugal heat dissipation fan of claim 1, wherein in a plurality of fan blades of the fan blade set located at the outer layer, each of the fan blades has another pair of arc-shaped side edges, and notches of the other pair of arc-shaped side edges face one of the two air inlets and the hub respectively, wherein the pair of arc-shaped side edges and the other pair of arc-shaped side edges are opposite to each other.

10. The centrifugal heat dissipation fan of claim 1, wherein the frame comprises a first combining portion, a connection portion, and a second combining portion, the first combining portion is embedded into the hub, the second combining portion is embedded into the fan blade set located at the outer layer, and the connecting portion is connected between the first combining portion and the second combining portion.

11. The centrifugal heat dissipation fan of claim 10, wherein a portion of fan blades of the fan blade set located at the inner layer is combined to the connecting portion.

12. The centrifugal heat dissipation fan of claim 1, wherein a thickness of the fan blades of the fan blade set located at the outer layer is smaller than a thickness of the fan blades of the fan blade set located at the inner layer.

13. A centrifugal heat dissipation fan, comprising:

a hub;

a frame; and double-layer fan blade sets surrounding the hub at an inner layer and an outer layer in a radial direction, wherein a gap is maintained between the fan blade set located at the inner layer and the fan blade set located at the outer layer along the radial direction, and the frame is connected to the hub and the fan blade set located at the outer layer, wherein the centrifugal heat dissipation fan has at least one air inlet disposed along an axial direction and at least one air outlet disposed along the radial direction, wherein in a plurality of fan blades of the fan blade set located at the inner layer, each of the fan blades has at least one arc-shaped side edge, and a notch of the arc-shaped side edge faces the at least one air inlet and the at least one air outlet without structural obstruction, so as to guide an airflow flowing into the centrifugal heat dissipation fan from the at least one air inlet to the fan blade set located at the outer layer.

14. The centrifugal heat dissipation fan of claim 13, wherein in a plurality of fan blades of the fan blade set located at the outer layer, each of the fan blades has at least one other arc-shaped side edge, a notch of the other arc-shaped side edge faces the at least one air inlet and the hub, and the arc-shaped side edge and the other arc-shaped side edge are opposite to each other to receive the airflow.

* * * * *